US007152509B2

(12) United States Patent
McCalley, Jr. et al.

(10) Patent No.: US 7,152,509 B2
(45) Date of Patent: Dec. 26, 2006

(54) FASTENER EXTRACTOR

(75) Inventors: Richard M. McCalley, Jr., Huntersville, NC (US); Mark T. Vogeler, New Gloucester, ME (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/066,020

(22) Filed: Feb. 25, 2005

(65) Prior Publication Data

US 2006/0191379 A1 Aug. 31, 2006

(51) Int. Cl.
*B25B 13/50* (2006.01)

(52) U.S. Cl. ..... 81/53.2; 81/441

(58) Field of Classification Search ..... 81/53.2, 81/441, 459, 177.5; 29/263, 281; 408/223–225
See application file for complete search history.

(56) References Cited

U.S. PATENT DOCUMENTS

| | | | | | |
|---|---|---|---|---|---|
| 574,077 | A | * | 12/1896 | Sellers | 81/53.2 |
| 1,105,535 | A | | 7/1914 | Roberts | |
| 1,108,059 | A | | 8/1914 | Zihler | |
| 1,227,876 | A | * | 5/1917 | Brinkhuis | 81/53.2 |
| 1,458,076 | A | | 6/1923 | Potts | |
| 1,554,287 | A | | 9/1925 | McGuckin | |
| 1,748,825 | A | | 2/1930 | Fabel | |
| 1,754,736 | A | | 4/1930 | Bryant | |
| 1,777,936 | A | | 10/1930 | Roberts | |
| 1,798,944 | A | | 3/1931 | Jackman | |
| 1,844,241 | A | | 2/1932 | Bryant | |
| 1,863,046 | A | | 6/1932 | Githens et al. | |
| 1,883,045 | A | | 6/1932 | Randall | |
| 1,875,484 | A | | 9/1932 | Nigra | |
| 2,013,923 | A | | 9/1935 | Naccarato | |
| 2,066,132 | A | | 12/1936 | Zihler | |
| 2,694,328 | A | * | 11/1954 | Lafreniere | 81/53.2 |
| 2,863,348 | A | | 12/1958 | Conger | |
| 3,263,533 | A | | 8/1966 | Carlson | |
| 4,078,458 | A | | 3/1978 | Berendzen | |
| 4,209,182 | A | | 6/1980 | Sheldon | |
| 4,503,737 | A | | 3/1985 | DiGiovanni | |
| 4,692,073 | A | | 9/1987 | Martindell | |
| 4,900,202 | A | | 2/1990 | Wienhold | |
| 5,013,194 | A | | 5/1991 | Wienhold | |
| 5,251,516 | A | | 10/1993 | Desaulniers | |
| D345,495 | S | | 3/1994 | Priddy | |
| 5,466,100 | A | | 11/1995 | Ahluwalia | |
| 6,098,499 | A | | 8/2000 | Pool | |
| 6,575,057 | B1 | | 6/2003 | Ploeger | |
| 6,595,730 | B1 | | 7/2003 | Bergamo | |
| 6,742,416 | B1 | | 6/2004 | Bergamo | |

(Continued)

FOREIGN PATENT DOCUMENTS

| | | |
|---|---|---|
| DE | 4143218 | 9/1992 |

*Primary Examiner*—Hadi Shakeri
(74) *Attorney, Agent, or Firm*—Dennis J. Williamson; Moore & Van Allen PLLC

(57) ABSTRACT

A fastener extractor and a method of extracting a fastener are provided. The fastener extractor includes a shaft, an engagement end at a distal end of the shaft and an attachment end at a proximal end of the shaft. The engagement end includes a plurality of helical ridges and grooves. The attachment end extends axially from the shaft and includes a hexagonal cross-sectional portion adapted to engage an extraction tool. Adjacent ones of the plurality of the grooves form the ridges therebetween and the plurality of ridges is adapted to engage a pre-formed opening in a fastener to be removed.

16 Claims, 3 Drawing Sheets

U.S. PATENT DOCUMENTS 6,877,402 B1 * 4/2005 Pigford et al. ..... 81/53.2
2003/0138228 A1 7/2003 Liu
2004/0000218 A1 1/2004 Bergamo
2004/0237725 A1 * 12/2004 Kozak ..... 81/53.2

* cited by examiner

FASTENER EXTRACTOR

FIELD OF THE INVENTION

The present invention relates to tools for turning threaded fasteners such as screws, bolts, nuts, studs, and the like, and more particularly relates to the use of an extractor tool for removing threaded fasteners having heads that have been broken off or otherwise damaged.

BACKGROUND OF THE INVENTION

It is well known to use extraction tools to remove threaded fasteners that have been damaged. Typically, these tools are either used in conjunction with a socket wrench, or else a wrench may be placed around the periphery of a squared end of the extraction tool in order to apply torque to remove the damaged fastener. These tools typically have "teeth" made up of angled faces to engage an opening in the damaged fastener. Extraction tools having scraping edges instead of teeth have also been used to remove fasteners, using a drill to drive the extraction bit into the end of the fastener and then reversing the drill to remove the fastener.

Extraction tools having teeth to engage the damaged fastener typically are designed to be attached to a wrench on one end, and to engage the fastener at the other end. These extraction tools are usually designed for placement in a pre-drilled hole within the end of the damaged fastener and then using the wrench or other tool, including a drill, to remove the fastener. Exchanging tools in the wrench or other tool can be cumbersome and time-consuming.

Accordingly, it would be desirable to have a fastener extractor that can be quickly inserted and removed from an extraction tool using a quick-release attachment end which overcomes one or more of the disadvantages of using a standard square end on a fastener extractor.

BRIEF SUMMARY OF THE INVENTION

To alleviate the disadvantages of the prior art, a fastener extractor is provided herein. The fastener extractor includes a shaft, an engagement end at a distal end of the shaft and an attachment end at a proximal end of the shaft. The engagement end includes a plurality of helical ridges and grooves. The attachment end extends axially from the shaft and includes a hexagonal cross-sectional portion adapted to engage an extraction tool. Adjacent ones of the plurality of the grooves form the ridges therebetween and the plurality of ridges is adapted to engage a pre-formed opening in a fastener to be removed.

In another embodiment of the present invention, a kit for extracting fasteners is provided. The kit includes a plurality of fastener extractors. Each of the plurality of extractors includes a shaft, an engagement end at a distal end of the shaft and an attachment end at a proximal end of the shaft. The engagement end includes a plurality of helical ridges and grooves. The attachment end extends axially from the shaft and includes a hexagonal cross-sectional portion adapted to engage an extraction tool. Adjacent ones of the plurality of the grooves form the ridges therebetween and the plurality of ridges is adapted to engage a pre-formed opening in a fastener to be removed.

In another embodiment of the present invention, a method is provided for removing a fastener. The method includes drilling an opening into the head of a fastener and providing a fastener extractor including a shaft, an engagement end at a distal end of the shaft and an attachment end at a proximal end of the shaft. The engagement end includes a plurality of helical ridges and grooves. The attachment end extends axially from the shaft and includes a hexagonal cross-sectional portion adapted to engage an extraction tool. The method further includes engaging at least a portion of the engagement end of the fastener extractor with the opening in the fastener and rotating the fastener extractor. Rotation of the fastener extractor relatve to the fastener causes the ridges of the fastener extractor to engage the fastener to loosen the fastener.

The invention provides a fastener extractor that is configured for engagement of a fastener to be extracted and allows for the convenient removal of damaged fasteners. The fastener extractor may be utilized with generally available tools to impart a large gripping and disengaging torque. The foregoing and other features and advantages of the invention will become further apparent from the following detailed description of the presently preferred embodiments, read in conjunction with the accompanying drawings.

DETAILED DESCRIPTION OF THE INVENTION

Figure 1:
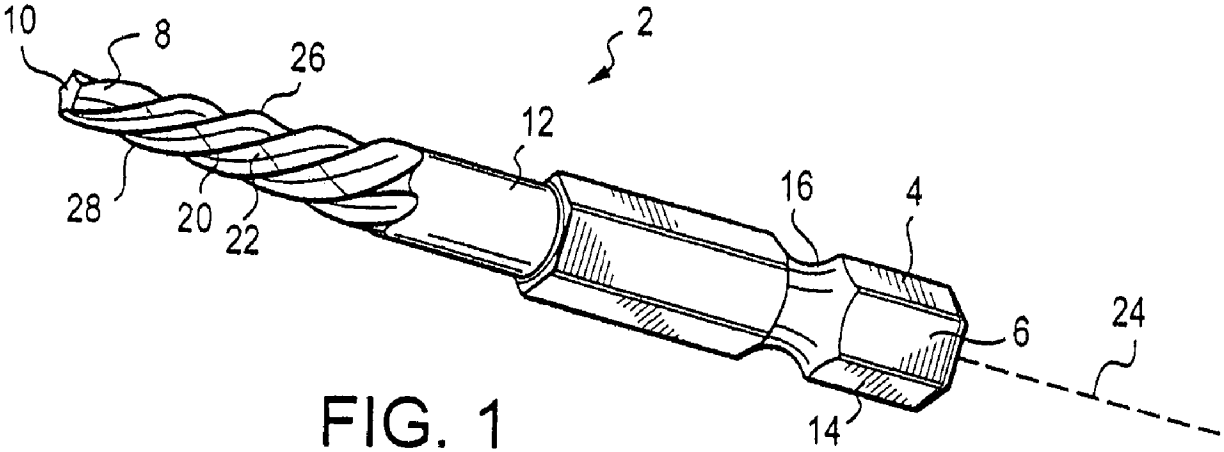
FIG. 1 is a perspective view of an embodiment of the present invention.

An embodiment of a fastener extractor 2 for removing threaded fasteners that have been damaged is shown in FIG. 1. The fastener extractor preferably is made of 4150 hardened steel, although in alternate embodiments other hardenable steels may be used that have a hardness in the range approximately 50 to 60 Rockwell C. In additional embodiments, moreover, powdered metals and other hardenable materials may also be used to make the fastener extractor.

Figure 2:
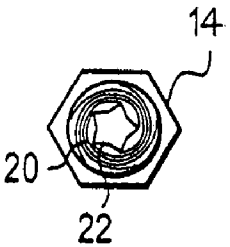
FIG. 2 is a front plan view of the embodiment of FIG. 1.

The fastener extractor 2 includes a shaft 12 having a tool attachment end 4 at a proximal end 6 and a fastener engagement end 8 at a distal end 10 of the shaft 12 of the fastener extractor 2. A portion of the elongate shaft 12 connects the tool attachment end 4 to the fastener engagement end 8. Referring also to FIG. 2, in a preferred embodiment the attachment end 4 includes a hexagonally shaped outer surface 14. The hexagonal portion 14 of the attachment end 4 may be used to facilitate the use of a quick-release chuck to attach the fastener extractor to an extraction tool 15 or to attach the attachment end 4 to a hex bit. The attachment end 4 may further include an arcuate groove 16 circumferentially surrounding the attachment end 4. The arcuate groove 16 is adapted to receive one or more detents (not shown), such as the detent balls in a quick-release locking mechanism in a tool chuck. The detents engage the arcuate groove 16 of the attachment end 4 to hold the fastener extractor 2 in the tool chuck. In an alternative embodiment, shown in FIG. 3, the attachment end 4 may include a hexagonally shaped outer surface 14 that extends from the attachment end 4 to the shaft 12. In these types of embodiments, the extraction tool may be, by way of example, a t-handled tap wrench, a socket wrench, an open wrench or a power tool. The attachment end 4 may be of any size known to one of skill in the art in order to fit with the extraction tool 15. The attachment end 4 may be any shape known to one skilled in the art including square or rounded and the like.

Figure 3:
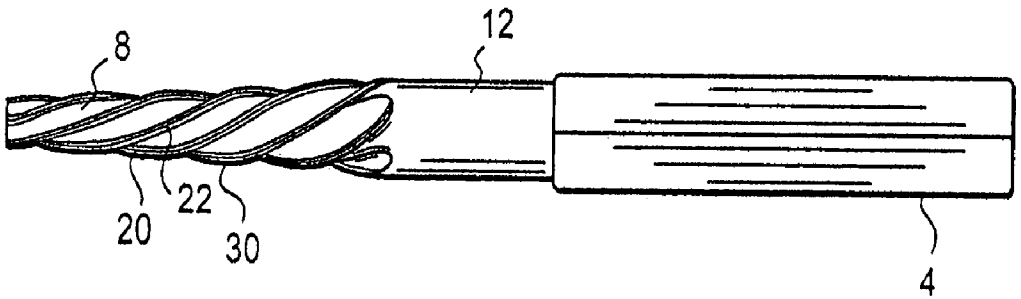
FIG. 3 is a perspective view of an alternative embodiment of FIG. 1.

The fastener engagement end 8 includes a plurality of helical ridges 20 and grooves 22 extending from the shaft 12 to the distal end 10 of the fastener extractor 2. The ridges 20 curve radially and outwardly and preferably taper from the shaft 12 to the distal end 10 along a longitudinal axis 24 extending the length of the fastener extractor 2. Preferably the ridges 20 and the grooves 22 may be equidistantly spaced apart and may each have a uniform size and shape. Alternatively, the ridges 20 and grooves 22 may be non-uniformly spaced apart and need not have a uniform size and shape. In a preferred embodiment of the present invention, the plurality of ridges 20 may be adapted to facilitate gripping of the fastener to be removed by the fastener extractor 2 without decreasing the strength of the outer surface 26 of the engagement end 6 and without removing material from the fastener itself. The ridges 20 may include angular ridges 28 as shown in FIG. 1 or smooth, radiused surfaces 30 as shown in FIG. 3 for engaging a hole formed in the fastener.

Figure 4:
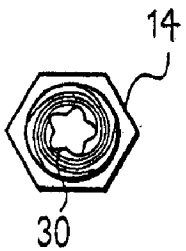
FIG. 4 is a front plan view of the alternate embodiment of FIG. 3.

Preferably the fastener extractor 2 includes a helical spiral engagement end 8 for removing a threaded fastener. The engagement end 8 may have a right-handed helical spiral or a left-handed helical spiral as viewed from the tip (as shown in FIG. 4) to remove an oppositely threaded fastener. The ridges 20 are formed by adjacent grooves 22 and any number of alternating ridges 20 and grooves 22 may be used for the engagement end 8. In the embodiments shown in FIGS. 1 and 3, the engagement end may include 3 to 8 ridges 20 and 3 to 8 grooves 22, preferably 5 ridges 20 and 5 grooves 22.

Figure 5:
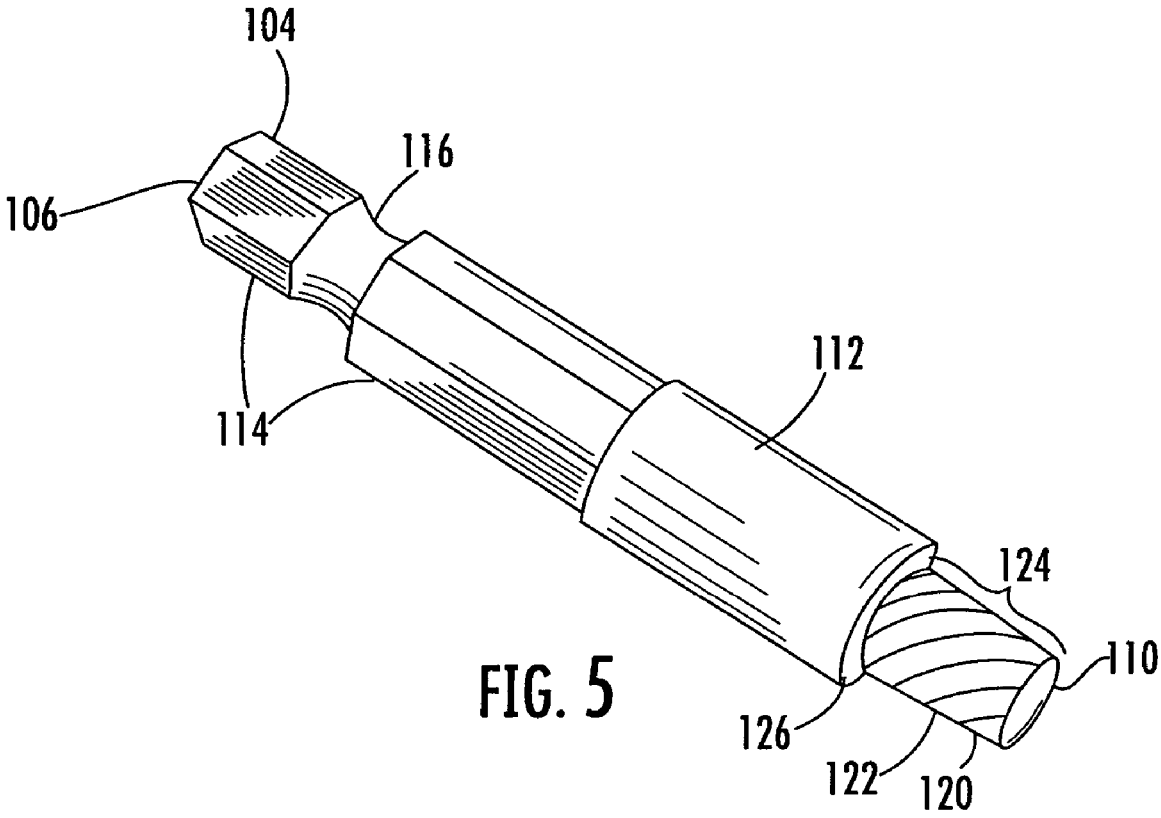
FIG. 5 is a perspective view of an alternative embodiment of FIG. 1.
Figure 6:
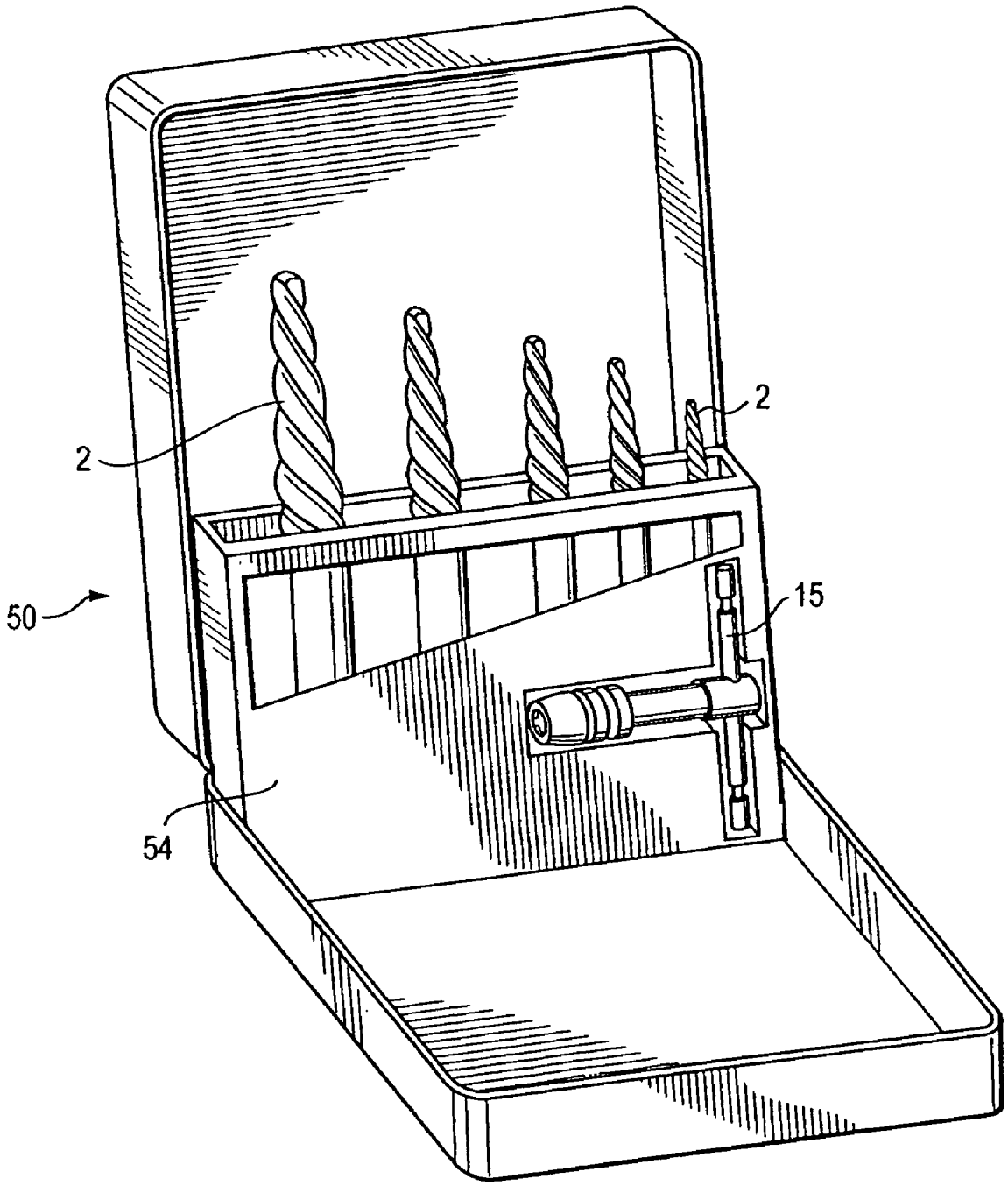
FIG. 6 is a schematic view of a kit.

As shown in an alternative embodiment in FIG. 5, the extractor 100 may include a larger number of ridges 120 and grooves 122. When a greater number of ridges 120 and grooves 122 are used, the ridges 120 and grooves 122 may be smaller and narrower. For each of the embodiments described herein, the number of ridges 20, 120 and grooves 22, 122 will depend on the size of the fastener extractor 2, 100 and the size of the fastener to be extracted as will be understood by one of skill in the art. The fastener extractor 100 is similar to the extractor 2 described above, and includes a shaft 112 having a tool attachment end 104 at a proximal end 106 and a fastener engagement end 108 at a distal end 110 of the shaft 112. A portion of the elongate shaft 112 connects the tool attachment end 104 to the fastener engagement end 108. The shaft 112 may be cylindrical in shape and may have a greater diameter than the attachment end 104 and the engagement end 108. The shaft 112 may be any shape and diameter known to one of skill in the art. The distal end 110 of the shaft 112 may be flat as shown in FIG. 5, however, any shape for the distal end 110 is acceptable, including circular, pointed and others. The extractor 110 may include a draft angle 124 tapering inwardly from the shaft 112 to the distal end 110. The draft angle 124 may be measured from a distal end 126 of the shaft 112 to the distal end 110. Preferably the draft angle 124 is about 2° to 8° inclusive, more preferably about 4° to 6° inclusive, most preferably about 4° inclusive.

In this embodiment, the attachment end 104 includes a hexagonally shaped outer surface 114. The hexagonal portion 114 of the attachment end 104 may be used to facilitate the use of a quick-release chuck to attach the fastener extractor to an extraction tool 15 or to attach the attachment end 104 to a hex bit. The attachment end 104 may further include an arcuate groove 116 circumferentially surrounding the attachment end 104. The arcuate groove 116 is adapted to receive one or more detents (not shown), such as the detent balls in a quick-release locking mechanism in a tool chuck. The detents engage the arcuate groove 116 of the attachment end 104 to hold the fastener extractor 100 in the tool chuck. The attachment end 104 may be of any size known to one of skill in the art in order to fit with the extraction tool 15. The attachment end 104 may be any shape known to one skilled in the art including square or rounded and the like.

As will be readily appreciated, the fastener extractor 2, 100 may be machined to various sizes in order to be used with a wide range of fastener sizes. For example, the fastener extractor 2, 100 may be used to remove fasteners that include but are not limited to sizes including 3/32-inch to 2½ inches.

Operation of the fastener extractor is as follows. The operation is described with reference to the fastener extractor 2 and the same operation applies to the fastener extractor 100. A hole is drilled into the damaged end of the fastener using a separate drill bit sized and shaped to bore an appropriate hole in the fastener. The size of the drill bit used to make this pre-formed hole will depend on the size of the fastener to be removed and the size of the fastener extractor 2 used to remove the fastener. The hole need extend only partially into the head of the fastener, but should be of a diameter wide enough to accommodate at least the tip portion of the extractor. The fastener extractor 2 is then inserted into the pre-drilled hole deep enough so that the ridges 20 of the engagement end 6 engage the sides of the hole. The extraction tool 15 is attached to the attachment end 4 of the fastener extractor 2 either before or after insertion of the ridges 20 in the hole of the fastener to facilitate rotation of the extractor 2. Rotation of the fastener extractor 2 relative to the fastener during loosening will cause the ridges 20 to bite into the fastener pushing the extractor 2 firmly into the hole during rotation to facilitate the extractor 2 biting into the fastener. Further rotation will cause the fastener extractor to be seated more firmly in the hole in the fastener due to the increasing diameter of the engagement end 6 towards the shank 12. Thus, rotation of the fastener extractor 2 continues until the fastener is removed from the substrate.

In another embodiment of the present invention, a kit 50 comprising a plurality of fastener extractors 2 is provided. As shown in FIG. 5, the kit 50 may include a plurality of sizes for the engagement end 6 of the extractor 2 and housed together in a set of such sizes. For example, in a preferred embodiment, the plurality of extractors may include extractors 2 having attachment ends 6 that range in size for removal of fasteners ranging in size from about 3/32-inch to 2½ inches. Other sizes for the receiving end 6 of the extractor 2, including metric units, are also possible. The kit 50 preferably includes 3 to 13 of the extractors 2, and more preferably, 5 to 9 of the extractors 2 adapted to engage the extraction tool 15, although the kit need not be so limited. The kit 50 may also include fastener extractors having different configurations for the engagement end as well as different configurations for the attachment end.

The kit 50 may further include the extraction tool 15. The extraction tool 15 may be adapted to drive the extractor 2 to remove threaded fasteners. The extraction tool 15 may be adapted to drive the extractor 2 by attaching to a generally hexagonal attachment end 4. In a preferred embodiment, the extraction tool 15 may be a t-handled tap wrench or a quick release chuck attached to a hand or power tool to drive the extractor 2. However, one of skill in the art will recognize that any extraction tool 15 may be used that will fit with the attachment end 4 of the fastener extractor 2.

Additionally, the kit 50 may include a container 54 adapted to house the plurality of extractors 2 therein. As will be readily understood by those skilled in the art, the container 54 may be any type of container adapted to house the plurality of extractors 2 and may also include the extraction tool 15. In a preferred embodiment, the container may be formed from molded plastic, include a re-closeable lid and include a plurality of recesses within the container adapted to receive each of the plurality of extractors 2 of the kit 50. The container may be used to display and sell the plurality of extractors 2 and to store the plurality of extractors after the kit 50 is sold. Alternatively, the container 54 may be a disposable container adapted to temporarily house the kit 50 for display for sale. Moreover, the kit may be made from materials other than plastic, such as, by way of example, acrylics or metal.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The claimed invention is:

1. A fastener extractor comprising:

a shaft defining a longitudinal axis;

an engagement end at a distal end of said shaft, said engagement end having a plurality of helical ridges and grooves, said plurality of ridges having a thickness, wherein said helical ridges include engagement surfaces and taper from said shaft to said distal end, where said taper is created by a change in the thickness of the plurality of ridges along the longitudinal axis, said thickness being defined as the difference in the distance from the longitudinal axis between one of the plurality of grooves and the engagement surface of an adjacent one of one of the plurality of ridges and wherein said engagement end further comprises a draft angle, said draft angle tapering inwardly from said shaft to said distal end; and an attachment end at a proximal end of said shaft, said attachment end extending axially from said shaft and having a portion adapted to engage an extraction tool;

wherein adjacent ones of said plurality of said grooves form said plurality of ridges therebetween, said plurality of ridges further comprise smooth, radiused surfaces with no sharp edges in the engagement surfaces and wherein the engagement surfaces of said plurality of ridges are adapted to engage a pre-formed opening in a fastener to be removed.

2. The fastener extractor claim 1 further comprising an arcuate groove circumferentially surrounding said tool attachment end, said arcuate groove adapted for engagement with one or more detents in said extraction tool.

3. The fastener extractor of claim 1, wherein said draft angle is about 4°.

4. The fastener extractor claim 1, wherein said shaft further comprises a cylinder.

5. The fastener extractor of claim 1 wherein said ridges are angular.

6. The fastener extractor claim 1 wherein said ridges extend in a left-handed spiral when viewed from the tip of said fastener.

7. A kit for extracting fasteners comprising:

a plurality of fastener extractors, each of said plurality of extractors comprising:

a shaft defining a longitudinal axis;

an engagement end at a distal end of said shaft, said engagement end having a plurality of helical ridges and grooves, said plurality of ridges having a thickness, wherein said helical ridges include engagement surfaces and taper from said shaft to said distal end, where said taper is created by a change in the thickness of the plurality of ridges along the longitudinal axis, said thickness being defined as the difference in the distance from the longitudinal axis between one of the plurality of grooves and the engagement surface of an adjacent one of one of the plurality of ridges and wherein said engagement end further comprises a draft angle, said draft angle tapering inwardly from said shaft to said distal end; and an attachment end at a proximal end of said shaft, said attachment end extending axially from said shaft and having a portion adapted to engage an extraction tool;

wherein adjacent ones of said plurality of said grooves form said plurality of ridges therebetween, said plurality of ridges further comprise smooth, radiused surfaces with no sharp edges in the engagement surfaces and wherein the engagement surfaces of said plurality of ridges are adapted to engage a pre-formed opening in a fastener to be removed.

8. The kit of claim 7 further comprising an extraction tool adapted to engage said attachment end.

9. The kit of claim 8, wherein said extraction tool is a hand tool.

10. The kit of claim 9, wherein said hand tool is a t-handled tap wrench.

11. The kit of claim 7 further comprising a container adapted to receive said plurality of fastener extractors.

12. The kit of claim 7 wherein said plurality of fastener extractors includes a plurality of sizes for said engagement end.

13. The kit of claim 7 wherein said plurality of fastener extractors includes a plurality of sizes for said attachment end.

14. A method of extracting a fastener comprising:

drilling an opening into the head of a fastener;

providing a fastener extractor having a shaft defining a longitudinal axis; an engagement end at a distal end of said shaft, said engagement end having a plurality of helical ridges and grooves, said plurality of ridges having a thickness, wherein said helical ridges include engagement surfaces and taper from said shaft to said distal end, where said taper is created by a change in the thickness of the plurality of ridges along the longitudinal axis, said thickness being defined as the difference in the distance from the longitudinal axis between one of the plurality of grooves and the engagement surface of an adjacent one of one of the plurality of ridges and wherein said engagement end further comprises a draft angle, said draft angle tapering inwardly from said shaft to said distal end, said ridges further comprise smooth, radiused surfaces, and an attachment end at a proximal end of said shaft, said attachment end extending axially from said shaft and having a portion adapted to engage an extraction tool; wherein adjacent ones of said plurality of said grooves form said plurality of ridges therebetween, said plurality of ridges further comprise smooth, radiused surfaces with no sharp edges in the engagement surfaces and wherein said plurality of ridges are adapted to engage a pre-formed opening in a fastener to be removed;

engaging at least a portion of said engagement surface of said fastener extractor with said opening in said fastener; and rotating said fastener extractor;

wherein the rotation of said fastener extractor relative to said fastener causes said ridges of said fastener extractor to engage said fastener to loosen said fastener.

15. The method of claim 14 further comprising engaging said attachment end with an extraction tool.

16. The method of claim 14 wherein rotating said fastener extractor further comprises rotating said fastener extractor with said extraction tool.

* * * * *